US005853016A

United States Patent [19]

Cowan

[11] Patent Number: 5,853,016

[45] Date of Patent: Dec. 29, 1998

[54] LIGHTWEIGHT VERTICAL WALL TENT

[76] Inventor: Michael Forest Cowan, 5196 Sonora Drive, North Vancouver, B.C., Canada, V7R 3V6

[21] Appl. No.: 429,150

[22] Filed: Apr. 26, 1995

[51] Int. Cl.[6] ..... E04H 15/04

[52] U.S. Cl. ..... 135/90; 135/115; 135/97; 135/907

[58] Field of Search ..... 135/90, 115, 119, 135/905, 117, 97, 907

[56] References Cited

U.S. PATENT DOCUMENTS

| | | | |
|---|---|---|---|
| 3,598,133 | 8/1971 | Abert et al. | 135/115 X |
| 3,741,224 | 6/1973 | Clelland | 135/119 X |
| 3,800,814 | 4/1974 | Hibbert | 135/119 X |
| 3,965,915 | 6/1976 | Kirkham | 135/119 X |
| 4,709,718 | 12/1987 | Nichols | 135/115 X |

FOREIGN PATENT DOCUMENTS

| | | | |
|---|---|---|---|
| 0026103 | 10/1953 | Finland | 135/119 |
| 819448 | 9/1951 | Germany | 135/119 |
| 0462552 | 3/1937 | United Kingdom | 135/119 |

*Primary Examiner*—Lanna Mai

[57] ABSTRACT

This invention is a very lightweight vertical wall tent including a waterproof cover or rain fly that can be erected or pitched by one person alone to form a semi-rigid roof-like structure with two identical rectangular planar surfaces each sloping at the same angle away from and symmetrically about a horizontal ridge, the rain fly held completely clear of the ground surface and in a fully functioning and stable position solely by single vertical ridge-end poles and guy ropes at each end of the ridge and by eight corner guy ropes, two at each of the four corners of the rain fly, all corner guy ropes connecting the corners of the rain fly to suitable anchors set in or on the surface on which the tent is pitched, prior to raising and supporting the ridge ends of the rain fly on the ridge-end poles, the corner guy ropes of the rain fly being adjustable and preset to specific lengths and their corresponding anchors being set at precise locations predetermined with respect to the final desired position of the erect rain fly, the erected rain fly then providing both shelter and the structural support for an enclosed box-like fabric chamber, referred to as a canopy, that is suspended from and beneath the rain fly and held in a fully functioning configuration entirely by the rain fly after the rain fly has been erected.

1 Claim, 3 Drawing Sheets

LIGHTWEIGHT VERTICAL WALL TENT

This invention is a very lightweight, backpackable, vertical wall tent, similar in configuration to traditional vertical wall tents, comprising a waterproof rain fly that covers and shelters an enclosed box-like fabric chamber, referred to as a canopy, that is attached underneath and suspended from the rain fly after the rain fly has been erected.

In terms of its weight and utility, the superiority of the invented tent to traditional wall tents has been achieved by the design of an innovative yet very simple system of lightweight structural support for the rain fly, requiring only two vertical ridge-end poles, one at each end of its ridge, ridge-end guy ropes, and eight corner guy ropes, two at each of the four corners of the fly, all guy ropes being attached to suitable anchors set in or on the surface upon which the tent is pitched. The system allows the pitching of the fly to be readily accomplished by one person alone. When erected properly, the fly provides a semi-rigid, very stable, waterproof, roof-like structure that remains securely fixed in three dimensional space completely clear of the ground surface, and capable of providing the entire structural support for a variety of very lightweight fabric canopies suitable for shelter in all seasons and under most climatic conditions.

Vertical wall tents of traditional design, each comprising a fabric chamber with a rectangular floor plan, a bilateral roof with two identical rectangular planar surfaces sloping away at the same angle from both sides of a common horizontal ridge, and with vertical end walls and side walls, and generally referred to in recent times simply as wall tents, have been in use for at least several centuries. These tents have been, and still are, almost without exception, made of canvas of such weight that each requires a horizontal ridge pole supported at each end by either vertical poles or A-frames, in order to keep the roof suspended in a functioning position. To provide a completely rainproof structure, even if the fabric of the chamber is treated to repel rainwater, a tarpaulin or other form of waterproof cover, referred to as a rain fly, or simply as a fly, is positioned over the ridge pole supporting the chamber, referred to as a canopy according to modern terminology, with the fly held in place by securing the ridge ends of the fly to the ends of the ridge pole and the corners and side edges of the fly to anchors set in or on the ground surface, or to horizontal side poles, by means of guy ropes. With a typical traditional wall tent the canopy is always pitched first, with any rain fly being added subsequently. When the ridge pole of the canopy is supported at both ends by vertical poles, the canopy itself becomes an integral part of its support system so the fabric of the canopy must be of sufficient strength to survive the stresses imposed upon it by the forces of wind or by snow loads, while maintaining the erect structural configuration. This dictates the use of relatively heavy fabric, such as canvas, for the canopy, resulting in a tent, even of only one-person capacity, that is too heavy to backpack.

Traditional wall tents have in the past provided, and continue to provide, optimum space and utility for temporary wilderness shelter where transportation of supplies and equipment is by horses, motorized all-terrain vehicles, snow machines, power boats, and small aircraft. However, the use of such tents in recreational wilderness activities such as backpacking, canoeing, kayaking, river rafting, and ski touring is precluded by their relatively great weight and bulk, including the heavy metal sectional poles that must be carried to pitch them where the cutting of saplings for tent poles is prohibited, such as within provincial, state, and national parks.

In most situations where a tent is used for portable wilderness shelter and transported daily on a traveller's back, the lightness of the tent is crucial to both the ability to travel and the enjoyment of the wilderness experience. This fact has led, during the past several decades, to the development, manufacturing, and marketing of an extensive variety of small backpackable tents made of lightweight nylon fabrics, each comprising a canopy of breathable, non-waterproof fabric, and a rain fly of coated, waterproof fabric, both supported by flexible lightweight aluminum or fibreglass poles forming dome or dome-like structures, referred to generally as dome or modified dome tents. Such tents, while lightweight, have numerous functional drawbacks.

Within a dome tent the greatest height is at one point, at the top or apex of the dome, and with a dome tent of backpackable size is usually of insufficient dimension to permit an occupant to stand erect within it. A dome tent with its apex of sufficient dimension to allow a person to stand erect beneath it must be of such size and weight that it would not be classed as lightweight or backpackable. Almost without exception, a backpackable dome tent requires its occupants to enter and move within on hands and knees or in a very stooped position. A dome tent requires a sewn-in floor for structural integrity, resulting in additional fabric weight. Such a sewn-in floor collects and traps dirt, water, mud, and snow that are inevitably brought into a tent by its occupants, and are difficult to remove. Warm air or moisture laden warm air generated by occupants or wet clothing within a dome tent rises and collects at and near the apex of its domal roof so that with its rain fly in place a dome tent provides extremely poor ventilation and drying capabilities. With a dome tent the fly is usually added after the canopy is erected, so that if the tent must be pitched in pouring rain, the sewn-in floor becomes wet before the canopy can be covered and protected by the rain fly. It is neither practical nor safe to use a woodburning stove within a small backpackable dome tent because of the low height and inward curving walls of the tent. Such a stove should not be placed near a domal wall since the wall curves inward and too close over the stove for its safe operation. The safest site for such a stove in a dome tent is at the center of the tent, with the stove vented by a vertical pipe through the apex of the dome, but a stove and stovepipe in that position severely limits movement and utilization of space within a dome tent. Furthermore, within a dome tent, any stovepipe port will be through the apex or a sloping surface of the dome and will allow rain water into the tent, and two coaxial stovepipe ports are required, one in the canopy and one in the rain fly. Most of the drawbacks cited here that apply to dome tents, apply also to the backpackable pyramid and teepee style tents that preceded the development of dome tents.

The tent invented and described herein has none of the inherent disadvantages of dome tents as cited above and is designed to surpass in performance and usefulness to the wilderness traveller or recreational camper, any of the so-called backpacker tents manufactured and marketed presently and in the past. The invented tent comprises a breathable fabric canopy conforming geometrically to the traditional wall tent design, that is, with a roof of two identical rectangular planar surfaces, both sloping at the same angle away from a common horizontal ridge, with vertical side walls and vertical end walls, and a rain fly made from either waterproofed fabric or reinforced polyethylene material similar to that used in polyethylene tarpaulins. While retaining the advantages of the space and utility provided by traditional wall tents, the invented tent is radically different in that its rain fly is pitched first to form a semi-rigid, stable structure beneath which its canopy is subsequently suspended and supported. The canopy of a traditional wall tent usually contains about two-thirds of the total square measure of material in the tent and its accompanying fly. With the invented tent, the rain fly acts as the supporting structure for the canopy, so the canopy is subjected to minimal stresses and can be made of very lightweight fabric which would be too delicate for use in the canopy of a traditional wall tent. Thus, the weight of the invented tent can be kept significantly less than that of a traditional wall tent of comparable size.

The weight of the invented tent can be kept very comparable to that of a dome type tent of equivalent floor area because the invented tent does not have the sewn-in floor that the dome tent requires for structural integrity and which adds significantly to the weight of fabric required for the dome tent. No ridge pole is required to pitch the invented tent and where poles for pitching must be carried, only two sectional ridge-end poles are required. With a dome tent the breakage or loss of any of its sectional poles can seriously impair its functioning, whereas the functioning of the invented tent is unlikely to be affected by damage to or loss of its poles because its sectional aluminum ridge-end support poles are readily straightened if bent, or spliced with wooden inserts if broken, or can be replaced by poles cut from live or dead saplings, or the tent can be pitched simply by tensioning the ridge of the fly between two standing trees. Its guy ropes, if damaged or lost, are readily replaced with any suitable cord or rope.

A sewn-in groundsheet or floor is not required for the structural integrity of the invented tent and without such a sewn-in floor the invented tent provides several significant advantages. The tent can be entered without having to remove footwear or wet raingear, tedious and inconvenient procedures required when passing in and out of tents with floors in order to keep the floors from accumulating dirt, mud, water, and snow. With such a floorless tent, individual groundsheets can be spread out for sleeping within it, are easily repacked for travel, and can be readily cleaned or dried when required. A considerable saving in weight is also gained by eliminating a tent floor and carrying individual lightweight groundsheets on which to sleep. Without a sewn-in floor, the invented tent can be pitched on very uneven or sloping ground and individual sleeping areas constructed within the tent after it is pitched. In contrast, a dome tent generally requires a flat, smooth surface on which to pitch it, since once it is erected the sewn-in floor obscures the ground surface beneath. Any subsequent modifications to the ground beneath a pitched dome tent requires the tent to be moved, entailing removal of all gear inside.

Without a sewn-in floor the invented tent can readily accommodate a woodburning stove that can be set directly upon the ground surface within the tent and operated safely at full heat. With a sewn-in floor, a portion of it where the stove is to be operated must be cut away or an effective heat shield must separate the base of the stove from the fabric floor beneath. Thus within the invented tent a small, lightweight, collapsible woodburning stove can be used for both space heating and cooking. Its stovepipe is readily and safely positioned through a port made of heat resistant material and installed in a front end wall or back end wall of the canopy, and by placing the stovepipe port at the center of a front end wall or back end wall of the canopy, the stovepipe can be secured directly to a ridge-end metal pole for support outside the canopy. With either arrangement, only a single stovepipe port is required, and rainwater will not enter the port since the port is in a vertical wall.

Because of its vertical wall design and horizontal ridge, the invented tent can readily incorporate a ridge height that allows an occupant to stand or move in a fully erect position at or near the ridge area, for the full length of the tent. When pitched on a well drained campsite, this feature, along with the absence of a sewn-in floor, allows an occupant to shower in the tent using a gravity feed system with either solar heated or fire-warmed water in a bladder or water container suspended outside and above the tent and fed inside through a lightweight plastic hose. The horizontal ridge allows a drying line or drying pole to be suspended between the two ridge ends inside the canopy just below and parallel to the ridge for the full length of the ridge, so wet clothing can be suspended to dry. The ample interior volume and headroom of the invented tent allows other activities within it, protected from rain or snow, such as sawing and splitting of firewood for a woodstove.

For a tent to function properly it must have effective ventilation. Because the canopy of the invented tent has vertical end walls, screened vents or windows can be placed high in both the front and back end walls and extending up to the ridge ends, so warm interior air rising to the ridge can escape from the canopy at both its ridge ends. This is an extremely important design feature for optimum ventilation, required especially when it becomes necessary to dry wet clothing during nightly camping, with or without the use of a woodburning stove in the tent, or in helping to keep the tent cool and habitable in hot weather or under a blazing sun.

An important design feature of the invented tent is that the side edges of the erect rain fly are held in a position completely clear of the ground surface, above and slightly overlapping the side walls of the canopy. While it is a very simple procedure to anchor the four corners of a rain fly directly to the ground and then raise and tension the ridge of the fly between two ridge-end poles to form a stable A-frame style roof-ike structure with both side edges extending to the ground, and then suspend a canopy beneath the fly, there are serious disadvantages to that system and the resulting tent. Firstly, the ridge height of the fly will vary if there are small errors in positioning corner anchors prior to securing the fly corners to the anchors and raising the ridge. This variability in ridge height can be accommodated by the use of adjustable ridge-end poles but they are more complex and costlier to manufacture than simple fixed-length sectional poles and more prone to malfunctions. Moreover, since the height of its canopy will be fixed, any variability in the height of the fly will have to be accommodated by varying the distance between the ridge of the fly and the ridge of the canopy, which in turn will make the clearance between the fly and canopy roof variable rather than optimum. Secondly, having the rain fly side edges extend to the ground surface can increase the square measure of fabric required for the fly by as much as sixty-five percent and thereby needlessly increase significantly the weight of the tent. Thirdly, a tent with its rain fly side edges extending to the ground surface restricts exposure of its canopy roof and side walls to ambient air currents moving horizontally between the fly and the canopy. In hot weather or under a hot sun this singular direction to air movement over the outer surface of the canopy roof and side walls allows higher temperatures to develop within the canopy, and in humid or very cold weather conditions it can permit the accumulation of condensation on the interior roof and side walls of the canopy. Fourthly, where such a tent might be subjected to extensive snowfall, having the side edges of its fly secured to the ground surface is an extremely poor configuration since snow will rapidly build up on the edges and if allowed to accumulate can eventually cause damage to the fly and the collapse of the tent. All of the above disadvantages are eliminated by the design of the invented tent. Firstly, with the invented tent all the corner guy ropes of the rain fly are adjustable, so after the rain fly is erect the corner guy ropes are adjusted to remove any slack in the fabric of the fly, eliminating any requirement for adjustable ridge-end poles and ensuring a constant ridge height for the fly when it is pitched and a constant and optimum clearance between the fly and its canopy roof when the canopy is fully erect. Secondly, the fly of the invented tent covers and slightly overlaps only the space directly above the roof of its canopy, so the square measure of material required for the fly, and subsequently its weight, can be kept to an essential minimum. Thirdly, with the invented tent the air between the fly and its canopy is not restricted to only horizontal movement parallel to the ridge of the fly. Breezes or wind blowing normal to the side walls of the canopy can pass between the top edges of the side walls and side edges of the fly and move within the space between the fly and the canopy roof, upwards and downwards, normal to the direction of the ridge. Thus the roof of the canopy and its walls are exposed to multidirectional ambient air currents, both wind induced and convective, that help in keeping the canopy interior cool in hot weather and in preventing the accumulation of condensation within the canopy in cold weather, by carrying away hot or moisture laden interior air expelled through its breathable fabric. Fourthly, because the side edges of the fly of the invented tent are held in place well above the surface of the ground, snow falling on the fly will be shed onto the ground along the side edges until it accumulates to the height of the side edges, so the tent is provided with a significant element of protection from snow damage when in use for winter camping.

The foregoing has shown that the design feature of the invented tent, whereby each side edge of the rain fly is held in a position completely clear of the ground surface, is very significant. It is noted here that although a fly similar to that described for the invented tent may be erected using only one guy rope at each of its four corners, each corner will, when the fly is subjected to wind stress, oscillate back and forth in a direction normal to the direction of its guy rope and within the plane of the surface of the erect fly at the corner. All four corners of the fly will tend to oscillate correspondingly and the ridge ends of the fly will shift their positions correspondingly, causing significant instability of the tent. With the invented tent, this instability is overcome and eliminated entirely by employing two guy ropes at each corner of the erect fly, one guy rope being in line with an end edge and normal to a side edge of the fly, and the other being at an angle of forty-five degrees, more or less, to both the end edge and the side edge of the fly, both guy ropes being within the plane of the surface of the erect fly at the corner. Some movement of each corner of the fly, in a direction normal to the plane of the surface of the erect fly at the corner, will occur when the fly is subjected to the forces of wind, but this movement does not affect the stability of the ridge or ridge ends which will remain fixed in their stable positions.

The invented tent provides significant advantages by being designed so that the rain fly is erected first and the canopy subsequently suspended under the fly after the fly has been secured in a stable functioning position. Since the fly forms the supporting structure of the tent, the fly bears the greatest stresses acting upon the fully erect tent. These stresses include a relatively large tensional stress along the ridge line, applied by the ridge-end guy ropes that keep the ridge of the tent suspended between the two ridge-end poles, and the tensional stresses at the four corners of the fly applied outward by the corner guy ropes that keep the two symmetrical sloping surfaces of the fly fixed in place. The canopy, suspended within and supported by the fly, is subjected to only minimal tensional stresses along its ridge and at its corners, just sufficient to keep the roof and side walls in functioning position. Thus, reinforcement of the canopy material at guy points can be kept to a minimum, simplifying the manufacturing procedure. As well, the canopy can be made of very lightweight fabric which would be too delicate to utilize in traditional wall tents. Another advantage is that when the tent is pitched in pouring rain, the rain fly provides shelter beneath which the canopy is kept dry while both unpacking it and suspending it in place. On striking camp in the rain, the canopy is removed and packed first, under the shelter of the fly, so the canopy is packed dry. A wet canopy can often weigh up to thirty percent more that its dry equivalent, so keeping the canopy dry is important in not adding significantly to the weight of the tent when it is being carried. If the fly is made of reinforced polyethylene, water absorption by the fly is eliminated entirely, and by shaking off rainwater before folding and stowing the fly for transport, additional load weight in the form of rainwater is kept to a minimum. By using a single sheet reinforced polyethylene rain fly, no seams are produced that would require sealing to make waterproof. Because the rain fly is suspended only at the ridge ends and corners and is not in contact with any horizontal ridge pole, it is not susceptible to any damage and leakage at the ridge line that could eventually be caused by movement of the fly against such a pole in the wind.

The fly of the invented tent covers and slightly overlaps only the space directly above the roof of the canopy, sheltering the canopy completely from rain and snow, so the canopy need not be waterproof in any way whatsoever and can be made entirely of breathable fabric. The use of such breathable fabric is essential, along with effective ventilation, in helping to keep the interior of the canopy cool when camping in hot weather or under a hot sun, and, when camping in winter or in conditions of extremely high humidity, in minimising the common problem of water or frost accumulation on the inside roof and walls of the canopy through condensation of water vapour from interior sources such as human perspiration, wet clothing, or water boiling on a stove. Moisture laden air generated within the canopy will pass through the breathable fabric of the canopy to the outside due to a pressure differential created when the temperature inside the canopy is greater than the temperature outside, as, for example, when the interior space of the canopy is heated with a woodburning stove, or even when the interior temperature rises solely from the body heat of its occupants.

The utility of the invented tent has been significantly improved over that of traditional side wall tents by having its rain fly form the supporting structure, because the fly can be used with or without a canopy, or with interchangeable canopies, each designed for specific seasons or climatic conditions. The rain fly provides protection from rain and snow in any season or climate. For temperate climates, a single fabric canopy, with screened windows at each ridge end for ventilation and adjustable window cover flaps to control that ventilation, can be suspended under the fly. For tropical climates, a canopy made completely of screen material can be suspended under the fly for protection from insects and snakes. For winter camping or in Arctic climates, two canopies, one slightly smaller that the other, can be suspended under the fly, one within the other, to form a double wall canopy that provides superior heat retention for extremely cold conditions. In warm weather conditions where insects are not a problem, only the rain fly need be erected to provide shelter from unexpected rainfall or protection from the sun.

The tent will be a valuable item of equipment for recreational wilderness activities such as backpacking, canoeing, kayaking, river rafting, winter camping, ski touring, and all other outdoor activities where effective portable lightweight shelter or lightweight heated shelter is necessary or desired.

In drawings which illustrate the embodiments of the invention:

FIG. 1 is an isometric perspective view of the rain fly resting flat and fully extended upon a level ground surface prior to raising and supporting its ridge ends on vertical ridge-end poles, with its two ridge ends at the same positions as the corresponding vertical projections of the ridge-ends of the erect fly will be upon the ground, and showing the predetermined positions on the ground of the lateral and diagonal anchors and the approximate positions of the ridge-end anchors, with the lateral guy ropes attached to the lateral anchors and the diagonal guy ropes attached to the diagonal anchors, the lateral and diagonal guy ropes all having been set to their correct predetermined lengths.

Figure 1:
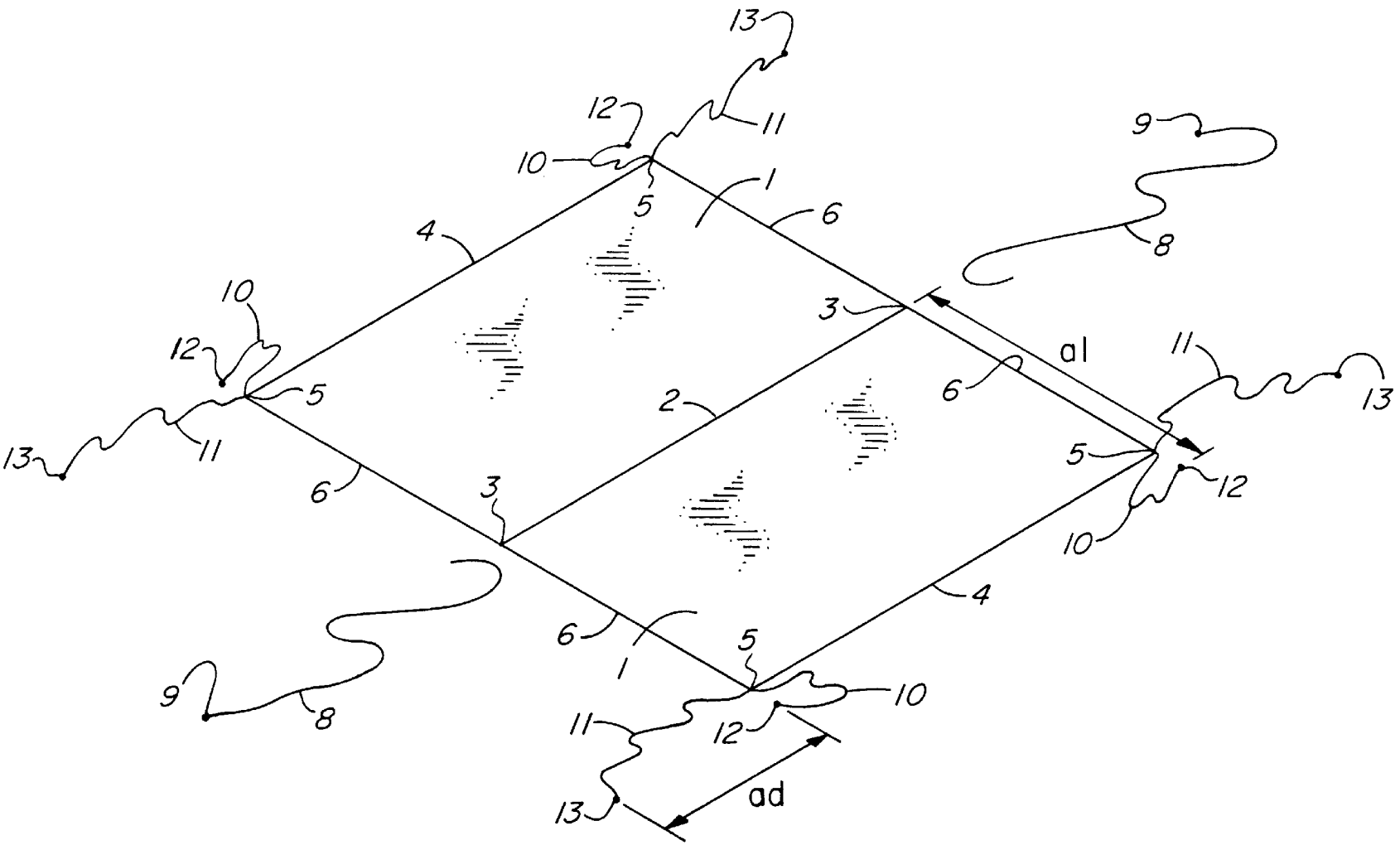

The invented tent (FIG. 3) comprises a waterproof rain fly (FIGS. 1 and 2) that in its erect configuration provides both shelter and the entire structural support for the canopy beneath it.

The erect rain fly (FIG. 2) is defined by two identical rectangular planar surfaces 1 symmetrical about a common ridge 2 extending between two ridge ends 3, each planar surface being bounded by the common ridge 2, a side edge 4 between two corner edges 5, and two end edges 6 each between a ridge end 3 and a corner 5. When the rain fly is erect on a level surface, its ridge 2 is horizontal and its two rectangular planar surfaces 1 both slope away from the common ridge 2 at the same angle. Both ridge ends 3 of the fly are supported on vertical ridge-end poles 7 and the ridge 2 is tensioned between and across the tops of the ridge-end poles by means of ridge-end guy ropes 8 attached to ridge-end anchors 9 positioned and set in or on the ground surface in line with the ridge 2 of the fly. Each of the four corners 5 of the rain fly is held outward, in tension, by a lateral guy rope 10 and a diagonal guy rope 11, the lateral guy rope attached to a lateral anchor 12 and the diagonal guy rope attached to a diagonal anchor 13, both anchors being set in or on the surface of the ground.

The erect fabric canopy (FIG. 3) beneath the rain fly is defined by a roof of two identical rectangular planar surfaces 14, each sloping at the same angle away from a common horizontal ridge 15 extending between two ridge ends 16, each planar surface being bounded by the common ridge 15 and a side wall top edge 17 between two upper corners 18, and by two roof end edges 19 each between a ridge end 16 and an upper corner 18. The canopy is further defined by two vertical side walls 20, each a rectangular planar surface and each bounded by a side wall top edge 17 and a side wall bottom edge 21 on the surface of the ground between two bottom corners 22, and by two corner edges 23 each between an upper corner 18 and a lower corner 22. The canopy is further and finally defined by vertical end walls 24, front and back, each a planar surface and each bounded by two roof end edges 19 symmetrical about a ridge end 16, by two corner edges 23, and by an end wall bottom edge 25 on the surface of the ground between two bottom corners 22.

In its fully erect configuration the canopy is centered under the rain fly and supported entirely by it, with each ridge end 16 of the canopy connected to each corresponding ridge end 3 of the fly by means of a canopy ridge-end guy 26, and each upper corner 18 of the canopy connected to each corresponding corner 5 of the rain fly by means of a canopy corner guy 27, and by securing the bottom edges 21 of the side walls and the bottom edges 25 of the end walls to suitable anchors set in or on the surface of the ground so that the side walls and end walls are vertical and the bottom edges of the side walls and end walls form a rectangle on the surface of the ground.

Prior to erecting the fly it is first necessary to decide on a position for the ridge of the erect fly and to then establish on the ground the positions of the eight corner anchors and the ridge-end anchors in relation to that position. This is best accomplished by spreading the fly out fully and flat upon the surface of the ground (FIG. 1) so that each ridge end 3 coincides with a point vertically below where that ridge end will be when the fly is erect. The bottom end of a vertical ridge-end pole supporting that ridge end of the erect fly will occupy the same point.

Figure 2:
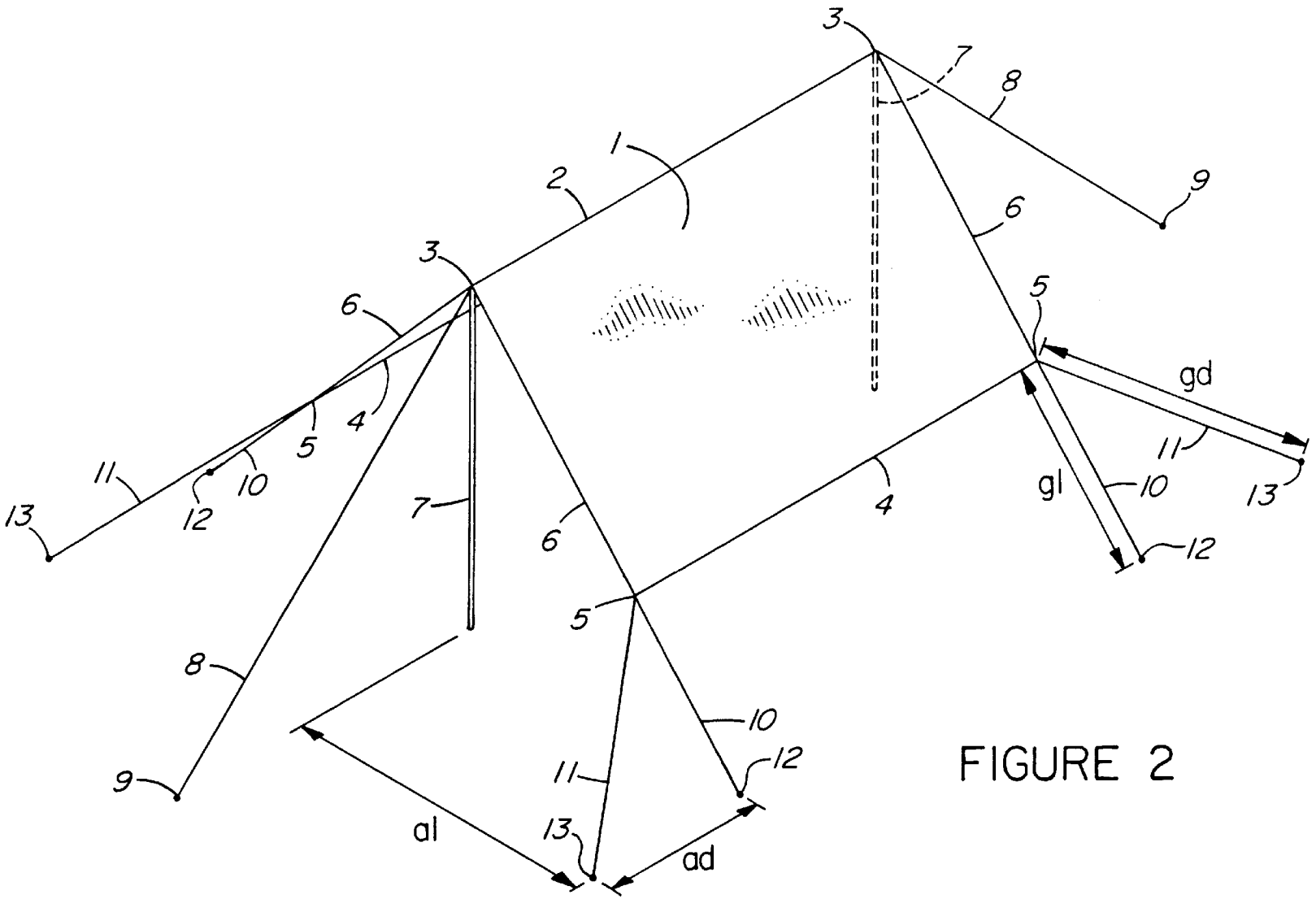
FIG. 2 is an isometric perspective view of the rain fly in its fully erect, semi-rigid, and stable functioning position on a level ground surface, after its ridge-ends have been raised and supported on vertical ridge-end poles and tensioned across them by ridge-end guy ropes attached to ridge-end anchors, and all eight corner guy ropes have been adjusted to remove any remaining slack in the fly.

With reference to FIG. 2, the correct position of each lateral anchor 12 can be defined as a point where a straight line coincident with an end edge 6 of the erect fly meets the ground surface. The correct position of each diagonal anchor 13 can be defined as a point where a straight line within the slope plane of the erect fly, passing through a corner of the fly, and bisecting, more or less, the right angle formed by the edges of the fly at that corner, meets the ground surface.

Each ridge-end anchor 9 set in or on the surface of the ground should be positioned in line with the ridge, outward from the base of its corresponding ridge-end pole a distance equal to, or greater than, the length of the pole.

With all eight corner anchors set in their correct positions, it is then necessary to attach all eight corner guy ropes, two at each of the four corners of the fly, to their corresponding anchors, and to adjust all the eight guy ropes to correct preset lengths. With reference to FIG. 2, the correct preset length of each lateral guy rope 10 is equal to the distance between a corner 5 of the erect fly and its corresponding lateral anchor 12. The correct preset length of each diagonal guy rope 11 is equal to the distance between a corner 5 of the erect fly and its corresponding diagonal anchor 13.

A simple method of determining the correct position of a lateral anchor is to draw to scale a front elevation orthographic view of the erect fly and measure the length al (FIG. 2), which is the distance, on the surface of the ground, in a direction normal to the ridge of the fly, that a lateral anchor is placed from a vertical projection of a ridge-end upon the ground. This same front view provides the correct preset length gl (FIG. 2) for a lateral guy rope. By drawing to the same scale an inclined orthographic view of the erect fly, normal to one of its slope planes, the length ad (FIG. 2) can be measured, ad being the distance, along the surface of the ground, of a diagonal anchor from a lateral anchor, in a direction parallel to the ridge of the fly. This same inclined view provides the correct preset length gd (FIG. 2) for a diagonal guy rope.

The lengths al, ad, gl, and gd can also be calculated using trigonometry and are determined to be as follows:

$$al=(w/2)+(s/\tan\theta)$$

$$ad=s/\sin\theta$$

$$gl=ad=s/\sin\theta$$

$$gd=s/[(\sin\theta)(\sin 45°)]$$

where w is the width of the erect fly, equal to the horizontal distance between and normal to its two side edges, s is the height of a side edge of the erect fly above the ground surface, θ is the true angle of slope of the erect fly on either side of its ridge.

Figure 3:
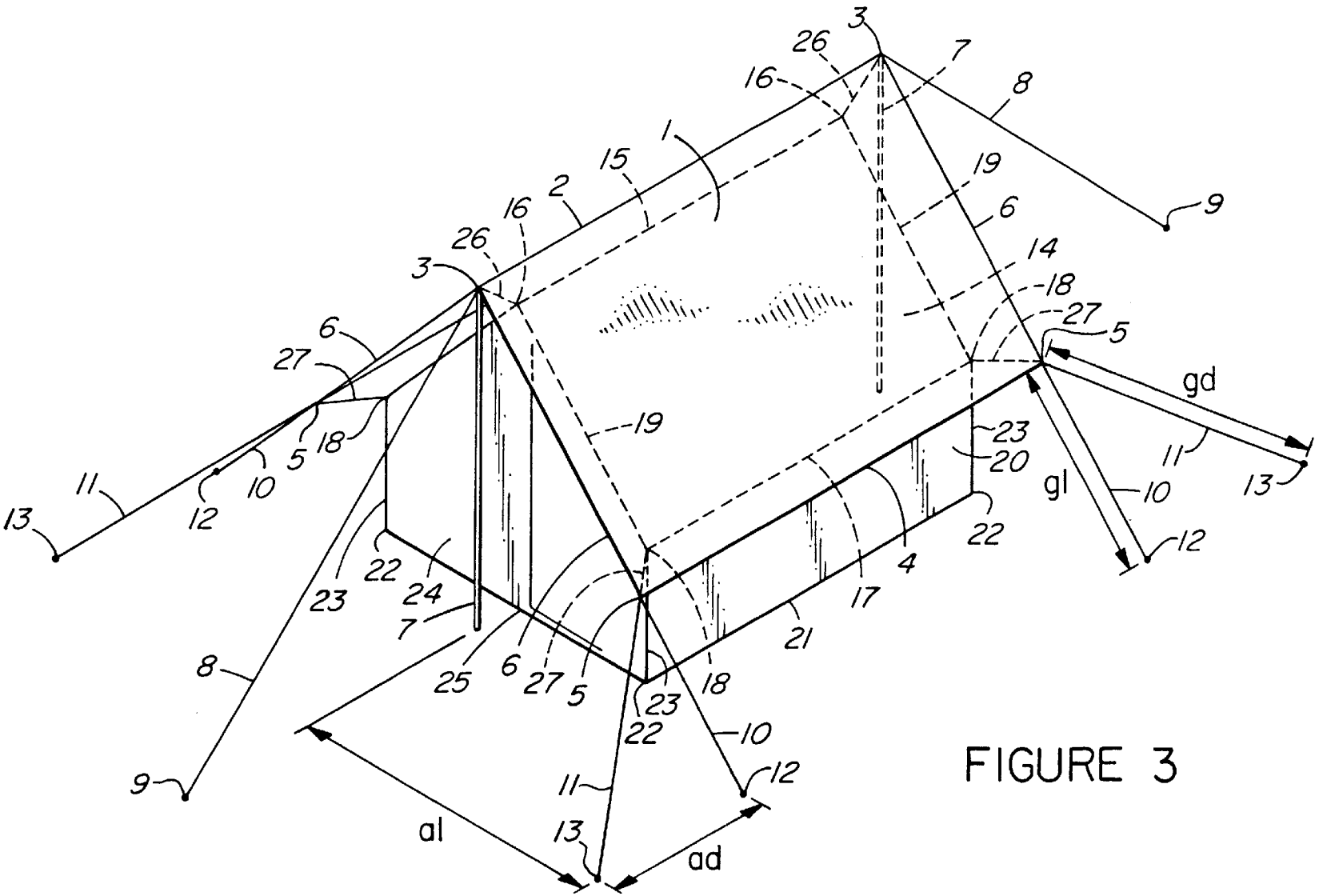
FIG. 3 is an isometric perspective view of the complete tent in its fully functioning position on a level ground surface, with the canopy suspended beneath and entirely supported by the rain fly.

The method and sequence of erecting or pitching the tent is described herewith, with reference to FIGS. 1, 2, and 3. The fly, with one lateral guy rope 10 and one diagonal guy rope 11, both adjustable, fastened to each of its four corners 5, is spread out completely and flat upon the surface of the ground (FIG. 1) with its ridge 2 positioned on the ground vertically below where it is desired to have the ridge 2 of the fly positioned when the fly is fully erect. Both ridge-ends 3 of the fly are temporarily secured in place on the ground by stakes or other suitable anchors. All four corners 5 of the fly are fully extended and the positions on the ground surface of all eight corner anchors are then determined by using the end edges 6 of the fly as linear guides and a premarked ridge-end pole as a measuring device for length. At each corner 5 of the spread out fly, one lateral anchor 12 is set the distance al from a ridge-end 3, in line with the end edge 6 containing the ridge end, and one diagonal anchor 13 is set the distance ad from the lateral anchor 12, in a line parallel to the ridge 2. With the fly still spread out upon the ground, all eight guy ropes are then attached to their corresponding anchors, with, from each corner of the fly, a lateral guy rope 10 being attached to a lateral anchor 12 and a diagonal guy rope 11 being attached to a diagonal anchor 13. Each lateral guy rope is adjusted to its correct preset length gl and each diagonal guy rope is adjusted to its correct preset length gd. Suitable ridge-end anchors 9 are set in or on the surface of the ground at each end of the ridge of the spread out fly, in line with the ridge 2 and a distance away from each ridge end 3 equivalent to at least the length of a ridge-end pole, and adjustable ridge-end guy ropes 8 are attached to the ridge-end anchors. The two temporary anchors holding the ridge ends of the fly on the surface of the ground are removed. A ridge end 3 of the fly is raised and supported on a vertical ridge-end pole 7 and secured with a ridge-end guy rope 8 attached to a ridge-end anchor 9 and then the opposite ridge end 3 of the fly is raised and supported on another vertical ridge-end pole 7 that is then secured with a ridge-end guy rope 8 attached to the other ridge-end anchor 9. The two ridge-end guy ropes are adjusted to fully tension the ridge across and between the tops of the ridge-end poles while maintaining the poles in their vertical positions, and the eight corner guy ropes are then adjusted to remove any slack in the fly. The fly now forms a stable, semi-rigid, roof-like structure from which the canopy is suspended by guying each ridge end 16 of the canopy to each corresponding ridge end 3 of the fly, the bottom edges of the canopy are secured with suitable anchors to the surface of the ground in a position such that the bottom edges 21 of the side walls are symmetrical in relation to the vertical projection of the ridge of the fly upon the surface of the ground, and the bottom edges 21 of the side walls and the bottom edges 25 of the end walls form a rectangle. And, finally, each upper corner 18 of the canopy is secured to each corresponding corner 5 of the fly by a canopy corner guy 27.

The embodiments of the invention in which an exclusive property or privilege is claimed are defined as follows:

1. A lightweight vertical wall tent, rectangular in plan, comprising a covering waterproof fabric or reinforced polyethylene rain fly that provides the entire structural support for a fabric canopy that is suspended from and beneath the fly after the fly is erected, the fly being erected by first attaching, while the fly is spread out flat upon the ground, eight adjustable guy ropes, two fastened to each of the four corners of the fly, to eight corresponding anchors set in or on the surface of the ground, two near each corner, with, at each corner, one guy rope, termed a lateral guy rope, being attached to an anchor termed a lateral anchor, and the other guy rope, termed a diagonal guy rope, being attached to the other anchor termed a diagonal anchor, all eight guy ropes being then adjusted to preset lengths, the positions of all eight anchors and the preset lengths of all eight guy ropes being a function of, and calculated from, the dimensions of the erect fly, including its angle of slope on either side of its ridge, the height of its ridge above the ground, its width, which is the distance between its two side edges in a direction normal to those edges, and the height of its side edges above the ground, the correct position of a lateral anchor being a point where a straight line coincident with an end edge of the erect fly meets the ground surface, the correct position of a diagonal anchor being a point where a straight line within the slope plane of the erect fly, passing through a corner of the erect fly and bisecting, more or less, the right angle formed by the edges of the fly at that corner, meets the ground surface, the correct preset length of a lateral guy rope being the distance between a corner of the erect fly and its corresponding lateral anchor, and the correct preset length of a diagonal guy rope being the distance between a corner of the erect fly and its corresponding diagonal anchor, so that with all eight corner guy ropes adjusted to their correct lengths and attached to their corresponding anchors correctly positioned and set, a ridge end of the fly is raised and supported on a vertical ridge-end pole and secured with a ridge-end guy rope to a ridge-end anchor on the ground in line with the ridge and then the opposite ridge end of the fly is raised and supported on a vertical ridge-end pole and secured with a ridge-end guy rope to the opposite ridge-end anchor on the ground in line with the ridge, the two ridge-end guy ropes then being adjusted to tension the ridge across and between the tops of the ridge-end poles, and the eight corner guy ropes then being adjusted to remove any remaining slack in the fly, leaving the fly supported solely by the two ridge-end poles, with the ridge held in tension across the ridge-end poles by the ridge-end guy ropes, and the four corners of the fly held outwards in tension and each prevented from movement by the two guy ropes at each corner, the erect fly thus forming a stable, semi-rigid, roof-like structure, securely held in three dimensional space completely clear of the ground, and entirely supporting and sheltering a fabric canopy that is suspended beneath it, the erect canopy having vertical side walls and vertical end walls and a roof formed by two identical rectangular planar surfaces, each sloping at the same angle away from a common horizontal ridge, the canopy held in place by the fly so that the canopy is centered beneath the fly with the ridge of the canopy vertically below the ridge of the fly, this being accomplished by having each ridge-end of the canopy guyed to each corresponding ridge end of the fly and each upper corner of the canopy guyed to each corresponding corner of the fly after the bottom edges of the canopy have been secured with suitable anchors to the surface of the ground in a position such that the bottom edges of the side walls and end walls will form a rectangle and the bottom edges of the side walls will be symmetrical with respect to the vertical projection of the ridge of the erect fly upon the surface of the ground.

* * * * *